US010022685B2

(12) United States Patent
Hattori

(10) Patent No.: US 10,022,685 B2
(45) Date of Patent: Jul. 17, 2018

(54) MIXING DEVICE FOR MIXING LIQUIDS IN A MIXING TANK

(71) Applicant: Uniflex Company, Ltd., Tokyo (JP)

(72) Inventor: Akira Hattori, Abiko (JP)

(73) Assignee: Uniflex Company, Ltd., Tokyo (JP)

( * ) Notice: Subject to any disclaimer, the term of this patent is extended or adjusted under 35 U.S.C. 154(b) by 700 days.

(21) Appl. No.: 14/138,157

(22) Filed: Dec. 23, 2013

(65) Prior Publication Data

US 2014/0177379 A1 Jun. 26, 2014

(30) Foreign Application Priority Data

Dec. 25, 2012 (JP) ..... 2012-280988

(51) Int. Cl.

| | |
|---|---|
| ***B01F 7/00*** | (2006.01) |
| ***B01F 9/00*** | (2006.01) |
| ***B01F 7/16*** | (2006.01) |
| ***B01F 7/28*** | (2006.01) |

(52) U.S. Cl.

CPC ..... *B01F 9/0003* (2013.01); *B01F 7/007* (2013.01); *B01F 7/0015* (2013.01); *B01F 7/00241* (2013.01); *B01F 7/00508* (2013.01); *B01F 7/1625* (2013.01); *B01F 7/285* (2013.01)

(58) Field of Classification Search

CPC .. B01F 7/00508; B01F 7/285; B01F 7/00241; B01F 7/0015; B01F 9/0003

USPC ..... 366/263

See application file for complete search history.

(56) References Cited

U.S. PATENT DOCUMENTS

| | | | | | |
|---|---|---|---|---|---|
| 1,031,666 | A | * | 7/1912 | Richmond | B01F 7/1625 261/93 |
| 1,375,406 | A | | 4/1921 | Merrell | |
| 2,183,071 | A | * | 12/1939 | Guthrie | B01F 3/04028 261/93 |
| 2,196,285 | A | | 4/1940 | Bachle | |
| 3,024,011 | A | | 3/1962 | Wurdack | |
| 3,415,650 | A | * | 12/1968 | Frame | B01F 7/285 366/172.2 |
| 4,743,428 | A | * | 5/1988 | McRae | B01F 7/285 266/204 |
| 4,893,941 | A | * | 1/1990 | Wayte | B01F 7/00241 366/265 |
| 5,292,194 | A | * | 3/1994 | Gabor | B01F 7/00241 366/262 |

(Continued)

FOREIGN PATENT DOCUMENTS

| | | | |
|---|---|---|---|
| CN | 102585079 | A | 7/2012 |
| DE | 681943 | C | 10/1939 |

(Continued)

*Primary Examiner* — Walter D. Griffin
*Assistant Examiner* — Marc C Howell
(74) *Attorney, Agent, or Firm* — Horizon IP PTE Ltd.

(57) ABSTRACT

Inside a driven cylindrical housing 23 that is a cylindrical rotation member 13, a liquid to be mixed 4 is caused to become an inner circulation current f by extruded plate portions 24A-24D. Discharge ports 22A-22D formed in the cylindrical housing 21 discharge a portion of the inner circulation current f outward as outer discharge current d1-d4 by centrifugal force. At the same time, the outer portion of the liquid to be mixed 4 is sucked into suction ports 23, 30 as suction current e1-e3, h1-h4, thus mixing the liquid to be mixed 4 in the mixing tank 3.

18 Claims, 4 Drawing Sheets

(56) References Cited

U.S. PATENT DOCUMENTS

| | | | | |
|---|---|---|---|---|
| 5,660,766 | A * | 8/1997 | Van Dyk | B01F 3/04539 261/87 |
| 6,712,980 | B1 | 3/2004 | Ahlström | |
| 2004/0022122 | A1* | 2/2004 | Kozyuk | B01F 3/0807 366/262 |
| 2010/0089428 | A1 | 4/2010 | Brinker et al. | |

FOREIGN PATENT DOCUMENTS

| | | | | |
|---|---|---|---|---|
| DE | 872198 | C * | 3/1953 | B01F 7/00241 |
| DE | 2016955 | A1 * | 10/1971 | B01F 7/00241 |
| DE | 3526834 | A1 | 1/1987 | |
| EP | 0970740 | A2 | 1/2000 | |
| EP | 1286240 | A1 | 2/2003 | |
| EP | 1925358 | A1 * | 5/2008 | B01F 3/0853 |
| EP | 2749348 | B1 | 7/2014 | |
| GB | 668886 | A | 3/1952 | |
| JP | S5131170 | U | 3/1976 | |
| JP | 4418019 | B1 | 2/2010 | |
| JP | 2010230342 | A | 10/2010 | |

* cited by examiner

MIXING DEVICE FOR MIXING LIQUIDS IN A MIXING TANK

CROSS-REFERENCE TO RELATED APPLICATION

This application claims priority to JP 2012-280988, filed on Dec. 25, 2012, entitled "Mixing Device", which are herein incorporated by reference for all purposes.

TECHNICAL FIELD

The present invention relates to a mixing device and more particularly to a mixing device that can enhance mixing capabilities for mixing liquids in a mixing tank.

BACKGROUND

Conventional mixing devices were structured such that an impeller-type mixing member was attached to a shaft (See patent documents 1 and 2).

In contrast, certain mixing devices do not have the configuration of impeller blades being attached to a mixing member. A cross-section of a circular shaped mixer body, as described in Patent Document 3, proposes a structure in which flow passages link inlet ports and outlet ports so as to blend two or more fluids, uniformly disperse powder added to a fluid, and to avoid damage and fluid contaminants associated with impeller blade mixing operation.

PRIOR ART DOCUMENTS

Patent Document (Patent Document 1) Unexamined Japanese Patent Publication 2010-230420

(Patent Document 2) US 2010/00894281A1

(Patent Document 3) U.S. Pat. No. 4,418,019

SUMMARY

Problems to be Solved by the Invention

In consideration of the above points, the present invention proposes a non-impeller-type mixing device with an improved mixing function so that dangers associated with operating an impeller blade-type mixer and the disadvantage of hazardous objects entering into the fluid being mixed can be overcome.

Means for Solving the Problem

In order to solve the problem, the present invention provides a mixer body 5 that rotates around the center axis line L1 of a cylindrical housing 21 which is a cylindrical rotating member 13 via a rotating drive shaft 11 connected to a top plate 13A that encloses the upper end of the cylindrical housing 21. The cylindrical rotating member 13 has a plurality of discharge ports 22A-22D formed in the peripheral surface of the cylindrical housing 21. Provided at the inner peripheral surface of the cylindrical housing 21 are a plurality of inwardly, projecting extruded plate portions 24A-24D. Provided at the bottom end of the cylindrical housing 21 is a suction port 23, 30. When the cylindrical rotating member 13 rotates, the extruded plate portions 24A-24D cause an inner circulation current fin which the liquid to be mixed 4 circulates around the center axis line L1.

A portion of the liquid to be mixed 4, that forms the inner circulation current f, is discharged outwardly, as outer discharge current d1-d4, by centrifugal force through discharge ports 22A-22D. At the same time, the liquid to be mixed 4 that is outside the cylindrical rotating member 13 is sucked into the cylindrical rotating member 13 as suction current e1-e3, h1-h4 via suction ports 23, 30.

Effects of the Invention

According to the present invention, inside the cylindrical housing, which acts as a cylindrical rotating member, are extruded plate portions that cause an inner circulation current of the liquid to be mixed when the cylindrical housing is rotated. Centrifugal force discharges a portion of the inner circulation current outwardly via discharge ports provided in the cylindrical housing. At the same time, liquid to be mixed that is outside the cylindrical housing is drawn therein as suction current via suction ports thus mixing the liquid in the mixing tank.

DETAILED DESCRIPTION

A first embodiment of the present invention will now be described with reference to the drawings.

(1) First Embodiment

Figure 1:
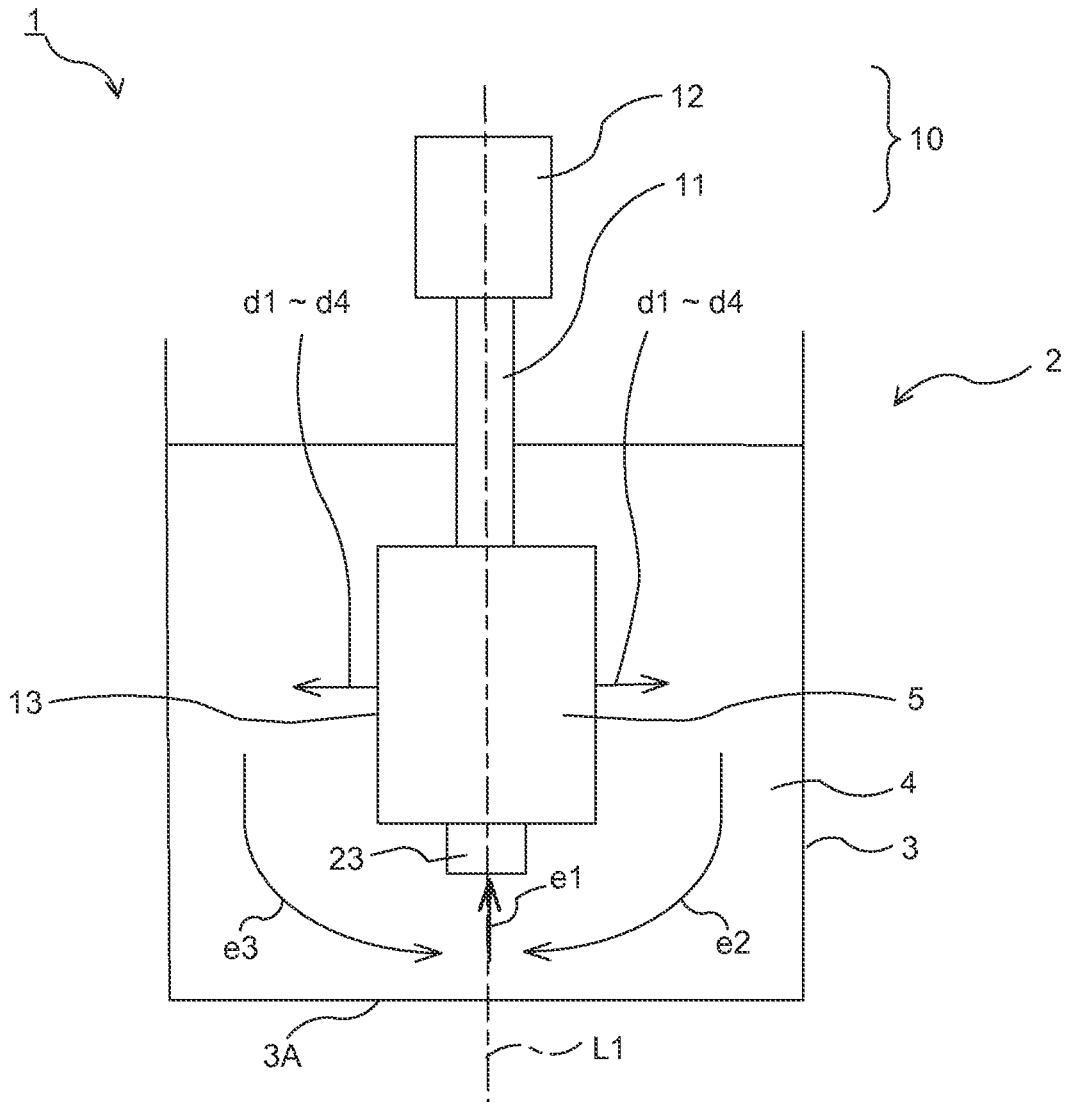
FIG. 1 is a schematic cross-sectional view illustrating a first embodiment of a mixing device of the present invention.

In FIG. 1, a mixing device 1 as a whole is illustrated in which a mixer body 5 having a cylindrical shape, is inserted vertically from the top of the liquid mixing portion 2 having a quadrate configuration, into the liquid mixing reservoir 3 that is filled with liquid to be mixed 4.

The mixer body 5 extends vertically from a rotation drive portion 10 and is attached to a lower end of a rotating drive shaft 11. The rotating drive shaft 11 extends vertically and is driven by rotation drive portion 10 around a center axis line L1.

Figure 2:
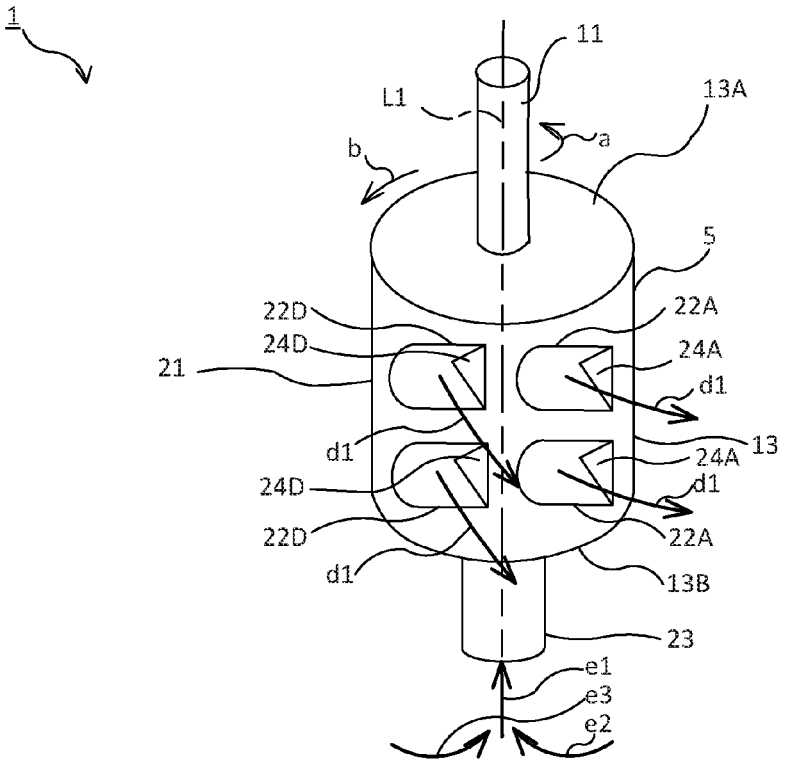
FIG. 2 is a perspective view illustrating a detailed configuration of a mixer body.

As shown in FIG. 2, the mixer body 5 has a cylindrical rotating member 13 in which the upper and lower surfaces of the respective top plate 13A and bottom plate 13B block the cylindrical rotating member 13. As shown by arrow a, when the rotation drive shaft 11, the lower end of which is integrally fixed to the top plate 13A, is rotated counter-clockwise, the cylindrical rotating member 13 rotates counter-clockwise as shown by arrow b.

Figure 3:
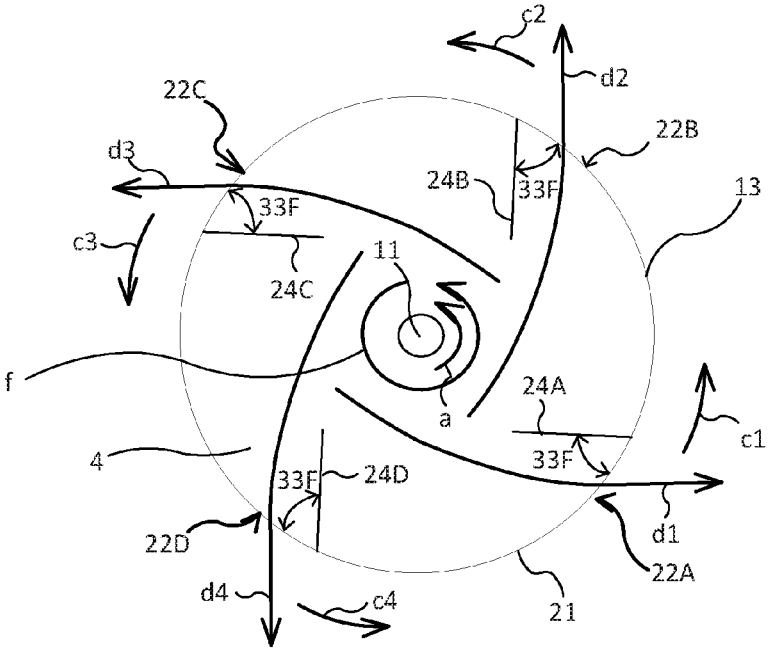
FIG. 3 is a cross-sectional view illustrating a detailed configuration of a cylindrical rotating member 13.

The rotating member 13, to which the upper surface and lower surface of the respective top plate 13A and bottom plate 13B are attached, has a cylindrical housing 21 made of a thin sheet of metal. In the outer surface of the cylindrical housing 21, as shown in FIG. 3, 4 discharge ports 22A-22D are formed at 90 degree angles around the center of the center axis line L1. At the same time, a suction tube 23, which communicates with the cylindrical housing 21 and has the function of being a suction port, protrudes downward from the center of the bottom plate 13B.

In this embodiment, the arrangement of the discharge ports 22A-22D is that they are formed vertically at intermediate positions in two levels in the cylindrical housing 21. Accordingly, there are 8 discharge ports formed in the cylindrical outer peripheral surface of the cylindrical rotating member 13 at 90 degree intervals.

At the end edges of the discharge ports 22A, 22B, 22C and 22D of the cylindrical housing 21 at the rotation direction b side, extruded plate portions 24A, 24B, 24C and 24D are formed in the direction toward the central axis line L1 side. Accordingly, when the cylindrical housing 21 containing the liquid to be mixed 4 is rotated in the rotation direction b, the liquid to be mixed 4 is forced out by the extruded plate portions 24A, 24B, 24C and 24D through discharge ports 22A, 22B, 22C and 22D to which said extruded plate portions 24A, 24B, 24C and 24D are adjacent thereto.

According to the above configuration, when the mixer body 5 has been inserted into the liquid to be mixed 4 and rotated by the rotation drive portion 10 in the direction of arrow a, the space between the extruded plate portion 24A of the discharge port 22A and the extruded plate portion 24B of discharge port 22B, the space between the extruded plate portion 24B of discharge port 22B and the extruded plate portion 24C of discharge port 22C, the space between the extruded plate portion 24C of discharge port 22C and the extruded plate portion 24D of discharge port 22D and the space between the extruded plate portion 24D of discharge port 22D and the extruded plate portion 24A of discharge port 22A at the circumferential surface of the cylindrical housing 5, moves in the same direction as arrow a as is illustrated by arrows c1, c2, c3 and c4.

At this time, as the above mentioned portions each move in the direction of c1, c2, c3 and c4, a portion of the liquid to be mixed 4 inside the cylindrical housing 21 comes in contact with the center portion of the cylindrical housing 21 and is drawn along by the movement.

From this, after the cylindrical rotation member 13 starts rotating and a stable rotation state is attained, the rotation operation draws along the liquid to be mixed 4 at the extruded plate portions 24A-24D. The rotation speed of the liquid to be mixed 4 around the center axis line L1 is the same rotation speed of the rotation drive shaft 11 (This is called inner circulation current f.).

The outer side of the liquid to be mixed 4, that forms the inner circulation current f, is drawn along by the rotation. The liquid to be mixed 4 centered around then central axis line L1 is dispersed outward by centrifugal force.

In due course, a portion of the inner circulation current f of the liquid to be mixed 4 that has been acted upon by centrifugal force, is discharged, as shown by arrows d1-d4 in FIG. 3, as an outer discharge current from discharge ports 22A-22D of the cylindrical housing 21 to the outer parts of the mixing tank 3.

With this embodiment, when discharge ports 22A-22D are punched in the outer circumference of the metal sheet portion of the cylindrical housing 21, plate members are positioned at the outer circumferential edge of the discharge ports 22A-22D forming a gap. These plate members are folded inward after machining to form extruded plate portions 24A-24D.

In that case, if the fold angle 33F relative to the inner side surface of the cylindrical housing 21 is, for example 45 degrees and if the cylindrical rotation m ember 13 is rotated, the extruded plate portions 24A-24D push the liquid to be mixed 4 in direction of the center axis line L1. In this way, the inner circulation current f forming operation can be easily carried out by the extruded plate portions 24A-24D.

At this time, only the portion of the liquid to be mixed 4 inside the cylindrical housing 21 that was dispersed as an outer discharge current d1-d4 is subject to negative pressure. As a result and as shown in FIG. 2, of the liquid to be mixed 4 that is inside the mixing tank 3, and the liquid to be mixed 4 around the suction tube 23, which serves as a suction port, is drawn there-through as illustrated by arrow e1 into the cylindrical housing 21 as suction current. Accordingly, as shown by arrows e2 and e3, liquid to be mixed 4 that is near the bottom plate 3A of the mixing tank 3 is gathered at the lower end of the suction tube 23 and drawn there-though as suction current e1.

At the time of this flow of the liquid to be mixed 4 that is inside the cylindrical housing 21, the outer discharge current d1-d4 is discharged from the discharge ports 22A-22D at the same time that suction current e1-e3 occurs from the suction tube 23. As a result, the liquid to be mixed 4 that is drawn into the suction tube 23 and after the inner circulation current f centers around the central axis line L1 of the cylindrical housing 21, a portion of the inner circulation current f is discharged outward as an outer discharge current d1-d4 to become a mixing current of the liquid to be mixed 4.

With the above configuration, the rotation of the cylindrical member 13 causes the occurrence of inner circulation current f therein. At the same time, centrifugal force causes a portion of the liquid to be mixed 4, as outer discharge current d1-d4, to go against the current. In addition, negative pressure is used to draw liquid 4 in the mixing tank 3 into the cylindrical housing and around the cylindrical rotating member 13, as indicated by the suction current e1-e3. The cylindrical rotating member 13 stirs and mixes the liquid. This produces a homogenized liquid in the mixing tank.

As the liquid to be mixed 4 as a whole can be engulfed in the mixing current, even if the mixing tank 3 is cylindrical or a quadrate or other shape, a uniform mixture can be made.

Actually, the discharge power of the outer discharge current d1-d4 and the suction power of the suction current e1-e3 can be controlled by appropriately determining the RPM of the cylindrical rotation member 13 thus enhancing the mixing function. In this way, the type of mix needed for the mixing tank 3, for example a gentle mix when a liquid to be mixed 4 is of low viscosity or a strong mix when a liquid to be mixed has a high specific gravity ratio or viscosity, can be determined.

In addition, in order to clean the mixer body 5, one simply needs to replace the liquid to be mixed 4 in the mixing tank, with a cleaning liquid (e.g. clean washing water, methanol, etc.) and perform the foregoing mixing operation. Thereafter, the spent mixing liquid is discarded thus obtaining a practical, sufficient cleaning.

(2) Second Embodiment

Figure 4:
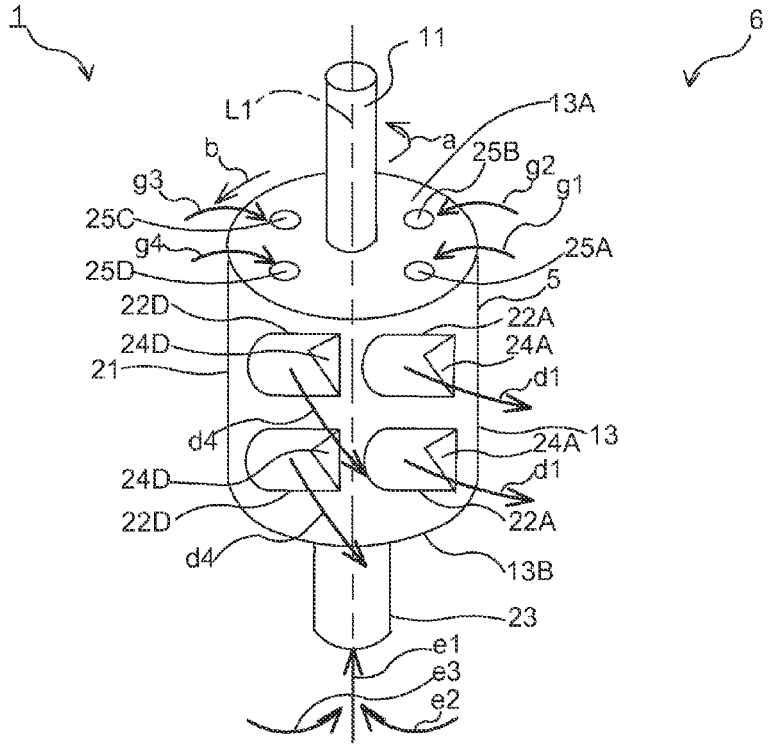
FIG. 4 is a perspective view illustrating a second embodiment of the mixer body.

As FIG. 4 illustrates a second embodiment of the mixing device 1, the same symbols as shown in FIG. 2 for corresponding elements will be used.

In the case of FIG. 4, intake ports 25A, 25B, 25C and 25D are formed in the upper plate 13A of the cylindrical rotation member 13 at 90 degree angles at equal intervals around the central axis line L1 so that liquid to be mixed 4 that is above the cylindrical rotation member 13 is drawn into the cylindrical rotation member 13 through the above mentioned intake ports 25A-25D.

Figure 5:
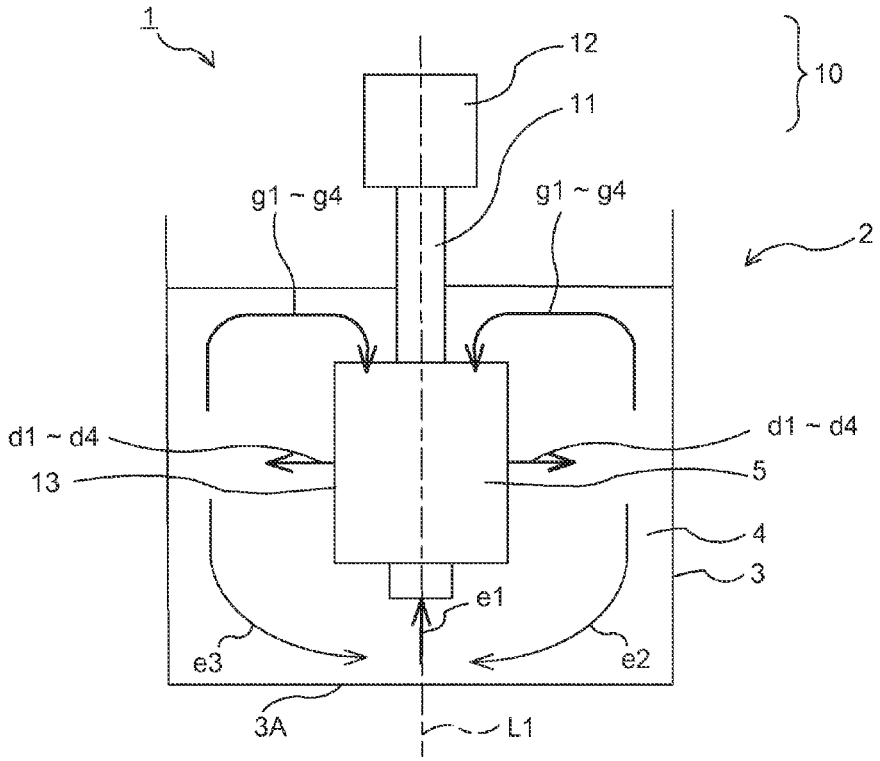
FIG. 5 is a schematic cross-sectional view illustrating mixing current inside the mixing device of the second embodiment.

Regarding the configuration in FIG. 4, the same symbols as shown in FIG. 1 for corresponding elements in FIG. 5 will be used. When the mixer body 5 that is inserted into the liquid to be mixed 4 in the mixing tank 3 is rotated by the rotation drive portion 10, as indicated in FIG. 2 and FIG. 3 above, an inner circulation current f is formed around the center of the center axis line L1 by the function of the extruded plate portions 24A-24D of the cylindrical rotation member 13 of the housing 21. At the same time, an outer discharge current d1-d4 is formed from the above mentioned inner circulation current f passing through the discharge ports 22A-22D. From this, suction current e1-e3 occurs at the lower end of the suction tube 23.

At this time, an inner circulation current f is generated inside the cylindrical housing 21 by the occurrence of a discharge current d1-d4 causing a negative pressure to the liquid to be mixed 4 that is above the discharge ports 22A-22D of the cylindrical housing 21. As a result, the liquid to be mixed 4 above the upper plate 13A is drawn into the cylindrical rotation member 13, as indicated by arrows g1-g4, as a suction current.

At the same time that a suction current e1-e3 is being formed at the lower portion of the cylindrical rotation member 13 that is inside the mixing tank 3, an intake current g1-g4 is formed at the upper part of the cylindrical rotation member 13 via intake ports 25A-25D.

In this case, because the intake current g1-g4 occurs in the vicinity of the surface of the liquid to be mixed 4 and serves as a water surface interface, the mixer body 5 is able to intermix air into the liquid to be mixed 4 thus forming bubbles at the liquid surface because the mixing function draws air therein. (This is called aerobic mixing.)

In relation to this, in the cases of the above-mentioned FIGS. 1 to 3, bubbles are not formed on the liquid surface as the mixing function does not draw air therein. (This is called anaerobic mixing.)

(3) Third Embodiment

Figure 6:
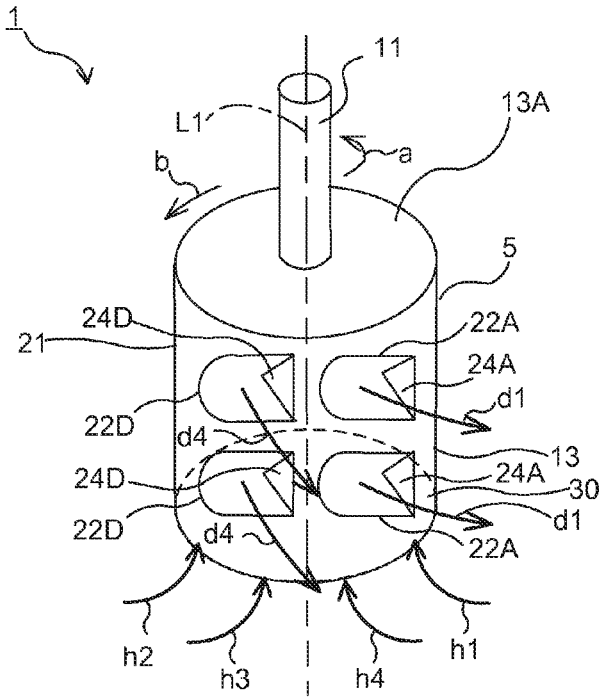
FIG. 6 is a perspective view illustrating a third embodiment of the mixer body.

As FIG. 6 illustrates a third embodiment, the same symbols as shown in FIG. 2 for corresponding elements will be used.

The configuration of the mixing device 1 according to this embodiment, is that the suction tube 23 and the lower plate 13B of the cylindrical rotation device 13 of FIG. 2, have been omitted.

As a result, the bottom of the cylindrical rotation member 13 is a cylindrical shaped communication hole 30, the diameter of which corresponds to the diameter of the cylindrical housing 21. The same symbols as shown in FIG. 1 for corresponding elements will be used for FIG. 7. Regarding this wide communication hole 30, the liquid to be mixed 4 in the area between the communication hole 30 and the bottom plate 3A of the mixing tank 3 is circulated by the sucking in of a large amount of liquid to be mixed 4 from around the communication hole 30 as suction current h1-h4 and then as outer discharge current d1-d4. In particular, a thorough mixing of the liquid to be mixed 4 at the bottom of the mixing tank can be performed.

In this case, if the cylindrical rotation member 13 is set so that the space between the bottom plate 3A of the mixing tank 3 and the bottom edge of the cylindrical rotation member 13 of the mixer body 5 is narrow, a strong suction strength of the mixing device 1, with respect to the liquid to be mixed 4 around the periphery of the bottom plate 3A of the mixing tank 3, can be obtained.

(4) Other Embodiments (4-1) The anaerobic mixing embodiments such as in FIGS. 1-3 and FIGS. 6-7 have numerous applications. While not limited in scope to this particular application, the mixing device 1 is ideal to use in a mixing tank when high precision is required such as that of an elution testing device for drugs.

In particular, when aerobic mixing in FIG. 4-FIG. 5 is included, the inner circulation current f formed inside the cylindrical rotation member 13 is acted upon by centrifugal force causing the outer discharge current d1-d4 to split forming a relatively simple flow passage. From this, thorough mixing can be made even if the liquid to be mixed 4 is of high viscosity or contains particles such as a liquid to be mixed at a sewage treatment facility.

(4-2) Regarding the above embodiments, the case was discussed where the cylindrical rotation member 13 has discharge ports 22A-22D, each having an extruded plate 24A-24D, formed vertically therein at two levels. However, the number of vertical levels formed is not limited to 2. There can be more than two levels and there can be more than 2 discharge ports in one level. The point is that these configurations obtain the same effect as above since an inner circulation current f is formed at the central axis line and centrifugal force creates a plurality of outer discharge currents via discharge ports.

(4-3) Regarding the embodiments discussed above, the cylindrical housing 21 is made of a thin sheet of metal into which discharge ports 22A 22D are cut in the outer surface forming a gap. The plate portions are folded inward at 45 degrees to form extruded plate portions 24A-24D. However, the fold angle 33F may be other than 45 degrees and the shape of the extruded plate portions 24A-24D may be adjusted to more easily form an inner circulation current.

(4-4) In addition, the vertical positioning relationship of the discharge ports 22A-22D and the extruded plate portions 24A-24D may be changed from one in which the heights are the same to one in which they are mutually shifted. In other words, it is sufficient as long as an inner circulation current f is formed inside the cylindrical rotation member 13 by the movement of the extruded plate portions 24A-24D and a portion of the inner circulation current f is discharged via discharge ports 22A-22D by centrifugal force.

(4-5) Regarding the embodiments of FIGS. 1-3 and FIGS. 6-7, the rotation drive shaft 11 was of a rod-like shape. However, a pipe shaped rotation drive shaft 11 may be applied in which air bubbles may be introduced into the mixing tank 3 via the hollow portion of the rotation drive shaft 11, thereby providing an aerobic mix.

In this case, the pipe shaped rotation drive shaft 11 is configured so that the upper end is above the liquid to be mixed 4 so as to discharge air. This causes a negative pressure to occur inside the cylindrical housing 21 when a portion of the inner circulation current f is discharged outward as an outer discharge current d1-d4. Air is thus mixed into the liquid to be mixed 4 that is inside the cylindrical housing 21 via the hollow portion of the rotation drive shaft 11.

Thus, a mixing device that enables aerobic mixing can be achieved.

In this way, when the rotation drive shaft 11 is in the shape of a pipe, the length of the pipe does not have to stop at the upper plate 13A but can pass through the upper plate 13A and into the cylindrical housing 21.

Figure 7:
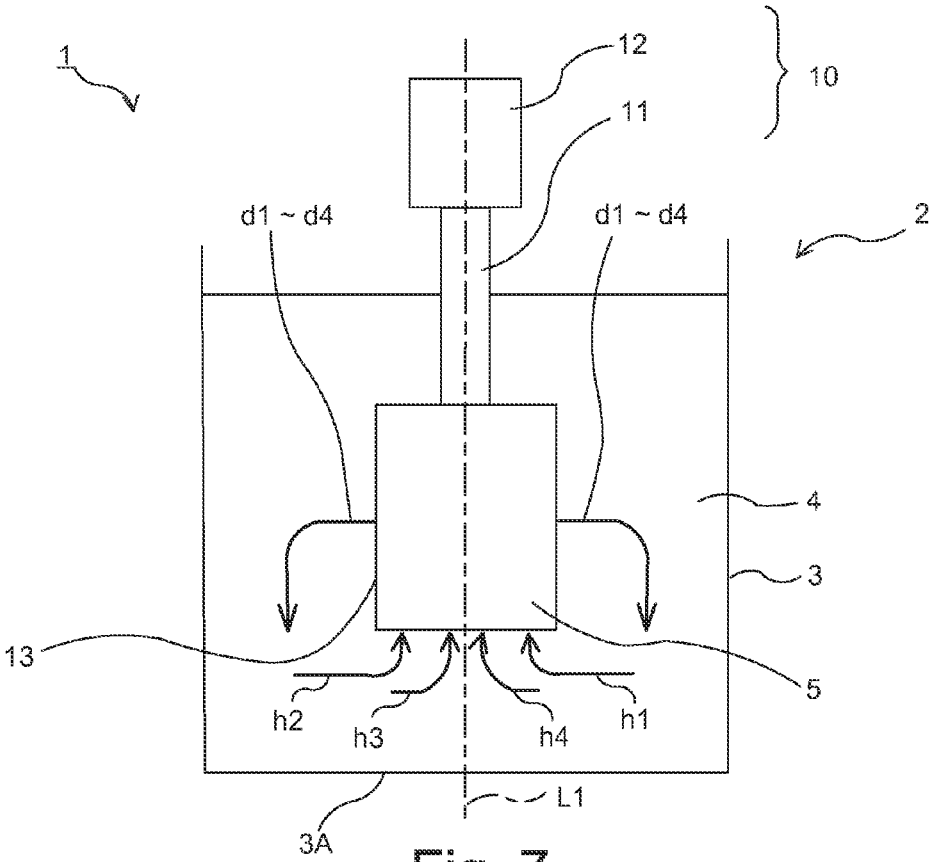
FIG. 7 is a schematic cross-sectional view illustrating mixing current inside the mixing device of the third embodiment.

When applied to the embodiments in FIG. 6-FIG. 7, this pipe shaped rotation drive shaft 11 can pass through the length of the cylindrical housing 21.

INDUSTRIAL APPLICABILITY

The present invention can be used for mixing a liquid to be mixed in a mixing tank.

EXPLANATION OF CODES

1. Mixing Device
2. Liquid Mixing Portion
3. Mixing Tank
4. Liquid to be Mixed
5. Mixer Body
6. Mixer
10. Rotation Drive Portion
11. Rotation Drive Shaft
12. Drive Motor
13. Cylindrical Rotation Member
13A. Top Plate
13B. Bottom Plate
21. Cylindrical Housing
22A-22D. Discharge Ports
24A-24D. Extruded Plate Portions
23. Suction Tube Portion
25A-25D. Intake Ports
d1-d4. Outer Discharge Current
e1-e3. Suction Current
h1-h4. Suction Current

What is claimed is:

1. A mixing device for mixing a liquid comprising:
a drive shaft;
a mixer body attached to an end of the drive shaft, wherein the mixer body comprises
a cylindrical rotating member having a cylindrical housing, the cylindrical rotating member is rotatable around a center axis line of the cylindrical housing,
a top plate, wherein the top plate encloses a top end of the cylindrical housing, wherein the top plate is integrally connected to the end of the drive shaft,
a plurality of discharge ports disposed in an outer circumferential surface of the cylindrical housing, wherein each of the discharge ports comprises a circumferential edge defined by the cylindrical housing, and
a plate member protruding inwardly from the circumferential edge of each discharge port, wherein each plate member extends integrally from an inner circumferential surface of the cylindrical housing, and comprises a first and a second major surface in a plane parallel to the center axis line, wherein the first or the second major surface of each plate member is angled about 45 degrees relative to the inner circumferential surface of the cylindrical housing; and
a suction port disposed at a bottom end of the cylindrical housing.

2. The mixing device according to claim 1 comprising a bottom plate disposed at the bottom end of the cylindrical housing, wherein the bottom plate encloses the bottom end of the cylindrical housing, wherein the suction port comprises a tube structure extending downwardly from the bottom plate.

3. The mixing device according to claim 2 wherein the tube structure comprises a substantially uniform diameter throughout, wherein the diameter of the tube structure is smaller than a diameter of the cylindrical housing.

4. The mixing device according to claim 1 wherein the cylindrical housing comprises an equal number of plate members and discharge ports.

5. The mixing device according to claim 1 wherein the suction port comprises a tube structure having a substantially uniform diameter throughout.

6. The mixing device according to claim 1 wherein each plate member is formed from a same material as the cylindrical housing.

7. The mixing device according to claim 1 wherein the discharge ports and plate members are disposed at 90 degree intervals from the center axis line.

8. The mixing device according to claim 7 wherein the discharge ports are disposed at intermediate positions in two levels on the outer circumferential surface of the cylindrical housing.

9. The mixing device according to claim 7 wherein when the cylindrical rotating member rotates, each plate member draws along a liquid to be mixed within the cylindrical rotating member to form an inner circulation current, wherein the inner circulation current circulates in one direction to encircle the center axis line, and the inner circulation current is interjacent an innermost edge of diametrically opposing plate members.

10. The mixing device according to claim 1 comprising a plurality of openings disposed at equal intervals around the center axis line in the top plate, wherein the top plate substantially encloses the top end of the cylindrical housing.

11. The mixing device according to claim 1 wherein the cylindrical housing is made of a sheet of metal and the top plate completely encloses the top end of the cylindrical housing, wherein the top plate is devoid of openings.

12. A method for mixing a liquid comprising:
providing a mixer body comprising
a cylindrical rotating member having a cylindrical housing, the cylindrical rotating member rotates around a center axis line of the cylindrical housing via a rotating drive shaft connected to a top plate that encloses a top end of the cylindrical housing,
a plurality of discharge ports disposed in an outer circumferential surface of the cylindrical housing, wherein each of the discharge ports comprises a circumferential edge defined by the cylindrical housing,
a plate member protruding inwardly from the circumferential edge of each discharge port, wherein each plate member extends integrally from an inner circumferential surface of the cylindrical housing, and comprises a first and a second major surface in a plane parallel to the center axis line, wherein the first or the second major surface of each plate member is angled about 45 degrees relative to the inner circumferential surface of the cylindrical housing;
a suction port disposed at a bottom end of the cylindrical housing;
inserting the cylindrical rotating member into a liquid to be mixed; and rotating the cylindrical rotating member to rotate the plate members, wherein the each plate member draws along the liquid to be mixed that is inside the cylindrical housing to form an inner circulation current, wherein the inner circulation current circulates in one direction to encircle the center axis line, and wherein a portion of the liquid to be mixed, that forms the inner circulation current, is discharged outwardly as an outer discharge current by centrifugal force through the discharge ports at the same time when the liquid to be mixed that is outside of the cylindrical rotating member is sucked into the cylindrical rotating member as suction current via the suction port.

13. The method according to claim 12 comprising a plurality of intake ports formed at equal intervals around the center axis line in the top plate of the cylindrical housing such that the liquid to be mixed that is outside of the cylindrical rotating member is drawn into the cylindrical rotating member through the intake ports.

14. The method according to claim 12 wherein the suction port comprises a tube structure protruding downward from the center of a bottom plate that encloses the bottom end of the cylindrical housing.

15. The method according to claim 12 wherein the rotating drive shaft has a pipe shape that serves to introduce air into the liquid to be mixed.

16. The method according to claim 12 wherein the suction port comprises a tube structure having a substantially uniform diameter throughout.

17. The method according to claim 12 wherein the inner circulation current comprises a rotation speed corresponding to about a rotation speed of the cylindrical rotating member.

18. The method according to claim 12 wherein the discharge ports and plate members are disposed in two levels on the circumferential surface of the cylindrical housing, and at 90 degree intervals from the center axis line, wherein the inner circulation current is interjacent an innermost edge of diametrically opposing plate members.

* * * * *